US005838284A

United States Patent [19]

Dougherty

[11] Patent Number: 5,838,284

[45] Date of Patent: Nov. 17, 1998

[54] SPIRAL-SHAPED ARRAY FOR BROADBAND IMAGING

[75] Inventor: Robert P. Dougherty, Bellevue, Wash.

[73] Assignee: The Boeing Company, Seattle, Wash.

[21] Appl. No.: 812,818

[22] Filed: Mar. 6, 1997

Related U.S. Application Data

[63] Continuation of Ser. No. 649,398, May 17, 1996, abandoned.

[51] Int. Cl.[6] ..... H01Q 21/00

[52] U.S. Cl. ..... 343/893; 343/700 MS; 343/770; 343/853

[58] Field of Search ..... 343/893, 700 MS, 343/769, 770, 771, 853, 792.5, 810; H01Q 21/00

[56] References Cited

U.S. PATENT DOCUMENTS

| | | | |
|---|---|---|---|
| 4,490,721 | 12/1984 | Stockton et al. | 343/700 MS |
| 4,956,614 | 9/1990 | Baril | 330/286 |
| 5,021,796 | 6/1991 | Corzine et al. | 343/712 |
| 5,175,561 | 12/1992 | Goto | 343/769 |
| 5,327,146 | 7/1994 | Jeon | 343/700 MS |
| 5,453,752 | 9/1995 | Wang et al. | 343/700 MS |

FOREIGN PATENT DOCUMENTS

| | | | |
|---|---|---|---|
| 4-358406 | 12/1992 | Japan | H01Q 21/06 |

*Primary Examiner*—Hoanganh T. Le
*Attorney, Agent, or Firm*—Conrad O. Gardner

[57] ABSTRACT

A phased array design in the shape of a logarithmic spiral. By distributing the elements of the array along a logarithmic spiral-shaped curve, spatial regularities are avoided and the array is therefore able to function over a wide frequency range.

2 Claims, 9 Drawing Sheets

SAMPLE SPIRAL-SHAPED ARRAY
100 ELEMENTS
INNER RADIUS = 4 INCHES
OUTER RADIUS = 30 INCHES
87 DEGREE SPIRAL ANGLE

SAMPLE OF PRIOR ART
SQUARE ARRAY, 100 ELEMENTS
42.4 INCHES ON A SIDE
60 INCH DIAGONAL

SAMPLE SPIRAL-SHAPED ARRAY
100 ELEMENTS
INNER RADIUS = 4 INCHES
OUTER RADIUS = 30 INCHES
87 DEGREE SPIRAL ANGLE

SPIRAL-SHAPED ARRAY FOR BROADBAND IMAGING

This application is a continuation of prior application Ser. No. 08/649,398, filed May 17, 1996, now abandoned.

BACKGROUND OF THE INVENTION

A phased array is a distribution of transducers (receivers, transmitters, or elements which perform both functions) in a certain spatial pattern. By adjusting the phase of the signal transmitted or received by each transducer, the array is made to function a single aperture with a strong, narrow beam in a desired direction. The direction of the beam can be controlled electronically by varying the transducer phases.

Phased arrays are employed in radar, sonar, medical ultrasonic imaging, military electromagnetic source location, acoustic source location for diagnostic testing, radio astronomy, and many other fields. The nature of the signal transmitted or received and the equipment necessary to manipulate it (including the phase adjustment) varies with the application. This invention does not address the design of the signal conditioning equipment or the transducers (antennas, microphones, or speakers) themselves. These issues are well understood by workers skilled in the various fields. The invention describes a particular spatial arrangement (actually a class of arrangements) of the transducers.

In many applications of phased arrays it is necessary for the system to function over a wide range of frequencies. This generally requires several distinct arrays because any single array designed according to the prior art is limited in the frequency range that it can cover. The frequency limitation arises from the relationship between the design of the array (meaning the the spatial arrangement of the transducers) and the wavelength of the radiation.

The lowest frequency at which a given array is effective is determined by the overall size of the array in wavelengths. The Rayleigh limit of resolution holds that the width of the beam (in radians) is given by the wavelength divided by the aperture size. The planar arrays considered here are roughly square or circular in overall shape. Let the diameter of a circle that is just large enough to contain the array be denoted by D. If the maximum acceptable beamwidth is 10 degrees (to take a particular example) then the then the longest wavelength at which the array can operate effectively is (10 degrees)×(2 pi radians/360 degrees)×D=D/5.72. The corresponding minimum frequency for the array is 5.72 c/D where c is the speed of sound or light, depending on the nature of the application. To restate the result, the minimum diameter of the array is 5.72 wavelengths at the lowest frequency of operation (for the example beamwidth requirement of 10 degrees). This low frequency limitation applies to all planar array designs, including the prior art and the present invention.

As the frequency is increased from the lower limit for an array, the beam becomes narrower since the ratio of the diameter to wavelength increases. A narrower beam is advantageous for most applications, so the array performance in this respect improves as the frequency increases. (If a constant beamwidth is desired, than it is possible to alter the transducer weight factors with frequency to prevent the beamwidth from decreasing. This technique should be familiar to workers who are familiar with phased array technology.) Above a certain frequency, the main beam is joined by additional, undesired, beams at angles different from the intended steering direction. These extra beams are known as sidelobes when they are weaker than the main beam, and aliases when they are at the same level as the main beam. For many applications, sidelobes are acceptable provided they are substantially lower than the main beam. The required degree of sidelobe suppression depends on the strength of interfering sources relative to the source of interest. To again provided a definite example, it is reasonable to suppose that the sidelobes must be 7 dB below the main lobe.

A common planar array design consists of rectangular array with the transducers filling a square grid. If the length of each side of the square is S, and the array is composed of n=m*m transducers, then the spacing between transducers is S/(m−1) in each of the two orthogonal directions in the plane. (The array diameter defined above is the diameter of a circumscribing circle, or S times the square root of 2.) For an array of this type, aliases occur when the frequency is sufficiently high that a half wavelength fits between a pair of transducers. For this array to function correctly, the wavelength must be greater than 2S/(m−1), which means the frequency must be less than c(m−1)/(2S). In terms of the aperture size, D, the operating frequency range of a square array is
5.72 c/D to 0.707 (m−1)c/D. For 10×10 array with 100 elements (m=10), the ratio of the upper frequency limit to the lower frequency limit is 6.3:5.72, which makes it essentially a single frequency design. To cover a frequency range of 50:1 (typically required in acoustic testing) with square arrays would require a prohibitive number of arrays.

To understand what limits the frequency range of square phased array, consider the receiving mode and suppose that a pure tone plane wave signal is normally incident on the array. Assuming identical transducers, all of the elements will receive the same signal with the same phase. The beamforming process underlying phased array operation consists of multiplying the signal from each transducer by a complex phasor and coherently summing the results. The phasors are determined so that the resulting sum is a maximum if the transducer signals correspond to a plane wave incident from the steering direction. To steer the beam to the direction normal to the array, the phasors are all unity. Since the actual signal is normally incident, the beamformer output in the when steering to the correct direction will be n times the response of each individual transducer. When expressed in decibels, the array gain is 20 log(n). If the beam is steered to a direction other than the true incidence direction of the wave, it is hoped that the beamforming sum will be a random phase sum, which will give an average amplitude result equal to the square root of n. In decibels, this result is 10 log(n ). The net array gain, comparing the true incidence direction with other directions, is 20 log(n) −20 log(n)=10 log(n). Now suppose the interelement spacing is greater than one half of a wavelength. In particular, suppose that the spacing is the wavelength divided by the square root of 2. If the array is steered to angle 45 degrees off of normal in one of the principal planes, then the steering phasors will again be unity, and the array will give a spurious maximum response in this direction. The problem is that the repeated interelement spacings of the array give rise to repeated phasor values for the steering coefficients for certain directions other than normal incidence. These repeated values, when summed in the beamforming, give a result larger than random phase sum expected for a direction that does not correspond to the true direction of incidence (normal in this case). It should be noted that the problem exists for all true directions for incidence; the normal direction was chosen for illustration because of its analytical simplicity.

Several attempts to extend the frequency range of planar arrays by altering the array shape have appeared in the literature. For example, arrays of nested triangles and product patterns with logarithmic spacing the horizontal and vertical directions have been proposed. These diminish the sidelobe levels by reducing the number of repeated spacings. They are not fully successful because they are still based on a regular geometrical pattern, and the phase sums still give spurious peaks in certain directions.

Some of the proposals in the prior art also cluster too many elements in a small region near the center of the array in an effort to have at least some spacings that will always be smaller than a half wavelength. This approach fails at both ends of the frequency range. At low frequency, the clustered elements are much closer together than a wavelength, so they make a large contribution to the beamforming sum that does not change with the steering direction. The effect is to broaden the central lobe and degrade the low frequency resolution relative to the Rayleigh limit. At high frequency the clustered elements can only partially reduce the sidelobes, because the outer elements are still spaced on a regular grid which is subject to sidelobe formation. The outer elements can be excluded from the sum at high frequency, but this reduces the array gain.

Arrays consisting of randomly distributed elements have been proposed. These have very poor sidelobe performance.

SUMMARY OF THE INVENTION

Accordingly, it is the primary object of this invention to extend the bandwidth of planar phased arrays.

This and other objects and advantages will be more clearly understood from the following detailed descriptions, the drawings, and specific examples, all of which are intended to be typical of of rather than in any way limiting the present invention.

Briefly stated the above object is attained by arranging the transducers on a logarithmic spiral curve. The logarithmic spiral is a natural shape which contains no fixed or repeated spacings. In polar coordinates, a logarithmic spiral is the curve defined by rho=$rho_0$ exp(phi/tan(gamma)), where rho and phi are the radius and polar angle of any point on the curve, the constant gamma is the spiral angle, and $rho_0$ is the initial radius corresponding to phi=0. In the following example, the transducers are equally spaced in arc length along the spiral curve, starting from rho=$rho_0$ and phi=0, although other spacings may be advantageous for special applications. The lack of fixed distances in the definition of the spiral shape results is a distribution of transducers which systematically avoids repeated spacings, and is consequently free from large sidelobes over a wide range of frequency.

DESCRIPTION OF THE DRAWINGS

Figure 1:
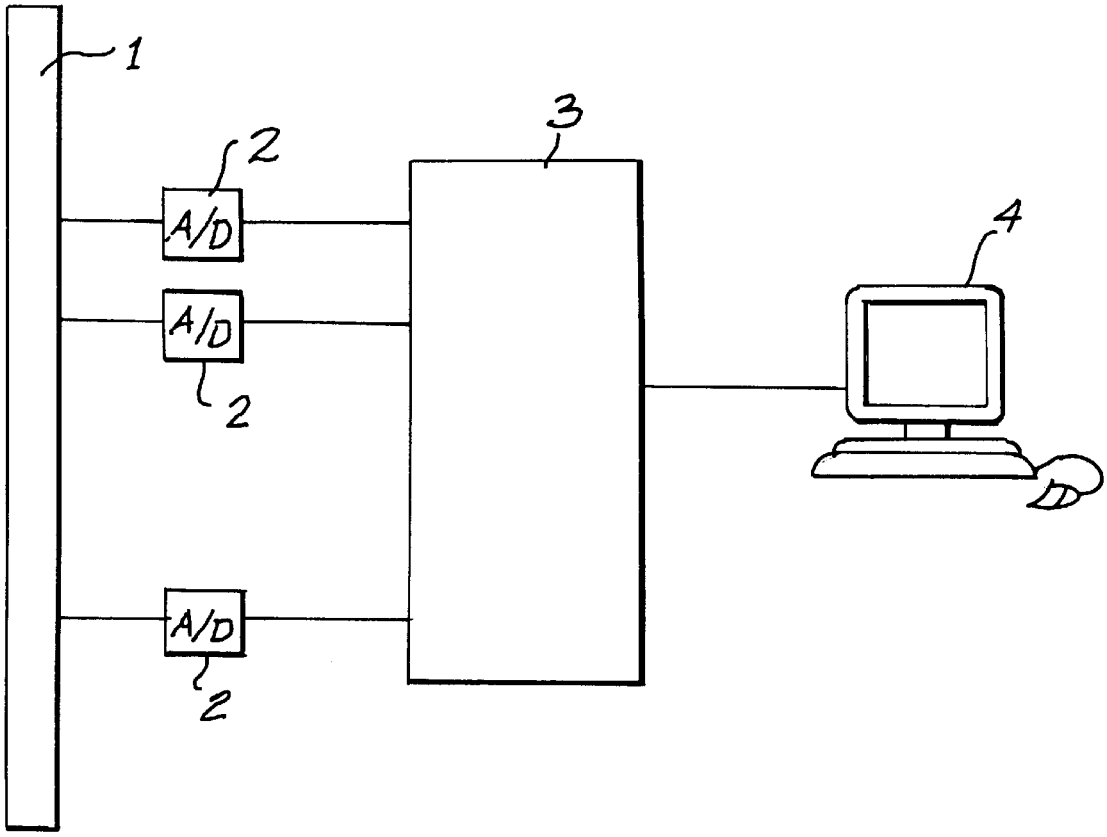
FIG. 1 is a block diagram of a phased array system.

The array is the key component of a phased array system. Other elements include power supplies, signal conditioning equipment, cables, a computer for performing the beamforming processing, and a display device. A very simple system is illustrated bellow:

FIG. 1 is a block diagram of a phased array system. The array 1 is a rigid structure in which the transmitting and/or sensing elements are mounted and retained in the predefined spatial relationship. The planar array is viewed edge-on in FIG. 1, so the elements cannot be seen. The transducers are connected by cables (and possibly other signal conditioning equipment) to a bank of A/D converters 2. (For transmitting, these would be D/A converters.) The signals from the A/D converters are carried to a computer 3, which performs the mathematical operations associated with beamforming. The results (source location and possibly other information) are displayed on the viewing device, 4.

Figure 2:
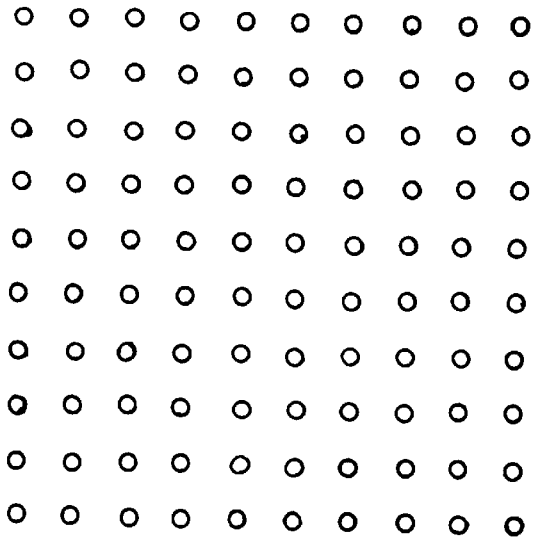
FIG. 2 is an example of prior art planar array design.

FIG. 2 is an example of the prior art in planar array design. It is a square array of 100 elements, with side S=42.4 inches and effective diameter (diagonal in, this case) D=60 inches. It is intended for acoustic beamforming in air with a sound speed c=13,000 inches/second. According to the analysis given above, its lower frequency limit (for 10 degrees resolution of better) should be 1239 Hz. It should exhibit aliases for frequencies of 1379 Hz and above.

Figure 3:
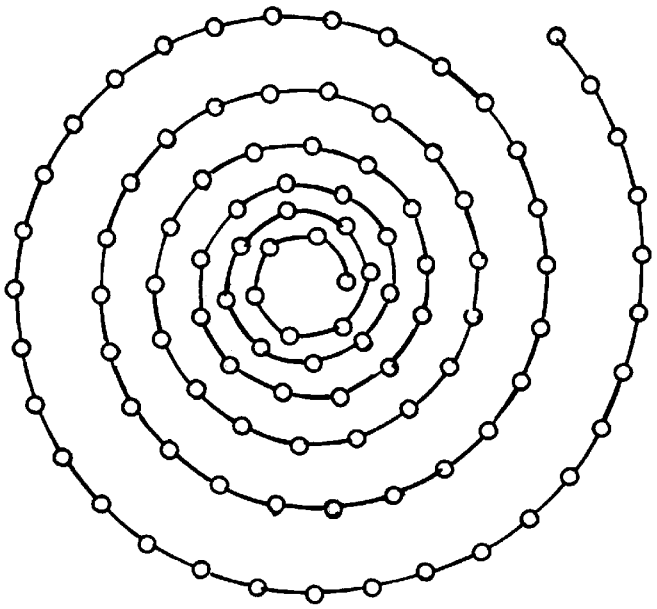
FIG. 3 is exemplary of the present invention.

FIG. 3 is an example of the invention. It is a logarithmic spiral of 100 elements with and inner radius $rho_0$=4 inches, an outer radius of 30 inches (and a diameter of 60 inches), and a spiral angle gamma=87 degrees. It should also have a lower frequency limit of 1239 Hz, but should not exhibit aliases at all, and should have acceptably low sidelobes up to much higher frequency than the limit for the square array of 1379 Hz.

The remaining Figures (FIG. 4 through FIG. 17) represent the performance of the two arrays at several frequencies. Each Figure is a representation of how the particular array would respond to a plane wave normally incident at theta=0 degrees. The beamforming amplitude response is plotted. Ideally, this response should be a sharp peak at theta=0 degrees, with no significant amplitude in other directions.

To summarize the actual response for a wide range of directions, each plot gives two curves: plotted versus the angle off of boresight, theta, are the maximum and minimum beamforming amplitudes over the 360 degree range of the azimuthal angle, phi. Each curve approaches 1 at theta=0, since the beamforming always correctly determines the amplitude of the incident plane wave. (The peaks become so sharp at high frequency that the curves are indistinguishable form the vertical axis.) For small values of theta near the central peak, it is desirable that the maximum and minimum curves match each other. This situation would indicate a circular peak corresponding to the plane wave direction. Differences between the minimum and maximum curves within the central peak indicate that the array output is not uniform with azimuth angle. Peaks that should be circular will appear elliptical. This is not a serious problem for either of the arrays illustrated.

The array's resolution is defined as the full width of the central peak at the as the 3 dB-down (half-power) point. The 3 dB-down point corresponds to a beamforming amplitude of alog(−3/20)=0.7. For example, FIG. 4. indicates that the resolution of the square array at 500 Hz is about 2×17=34 degrees. This was expected to be larger than 10 degrees because 500 Hz is below the 1239 Hz limit predicted by the Rayleigh formula.

For illustration, suppose that the maximum acceptable sidelobe level is 10 dB down from the peak. This corresponds to a beamforming amplitude of 0.316. The Figures indicate a problem with sidelobes if the maximum curve crosses above 0.316 outside the central peak. (These Figures do not represent the most stringent possible test for sidelobes. This would require that both the incidence and observation directions should be swept over the hemisphere. They do give a general idea of the arrays's sidelobe characteristics, however.)

Figure 4:
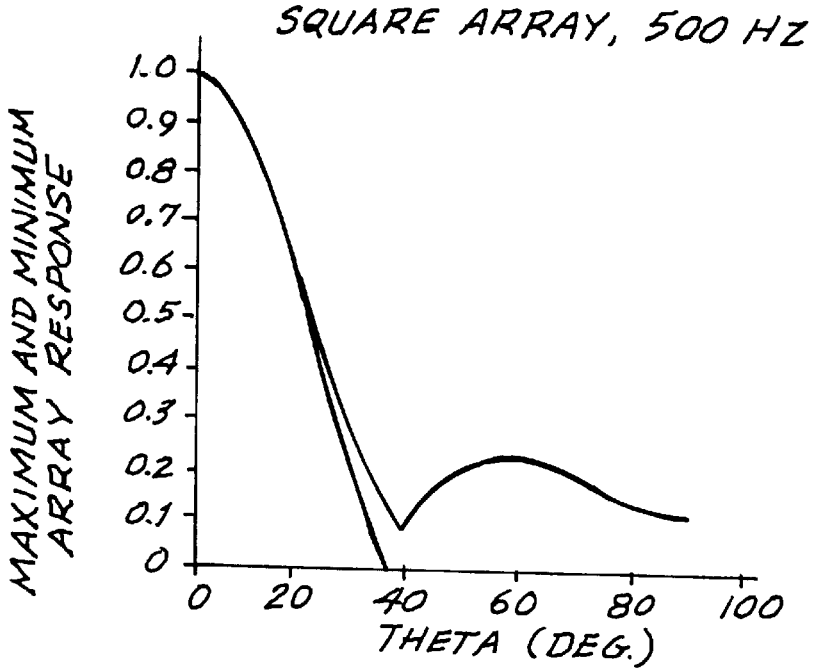
FIG. 4 summarizes the performance of square array at 500 Hz.
Figure 5:
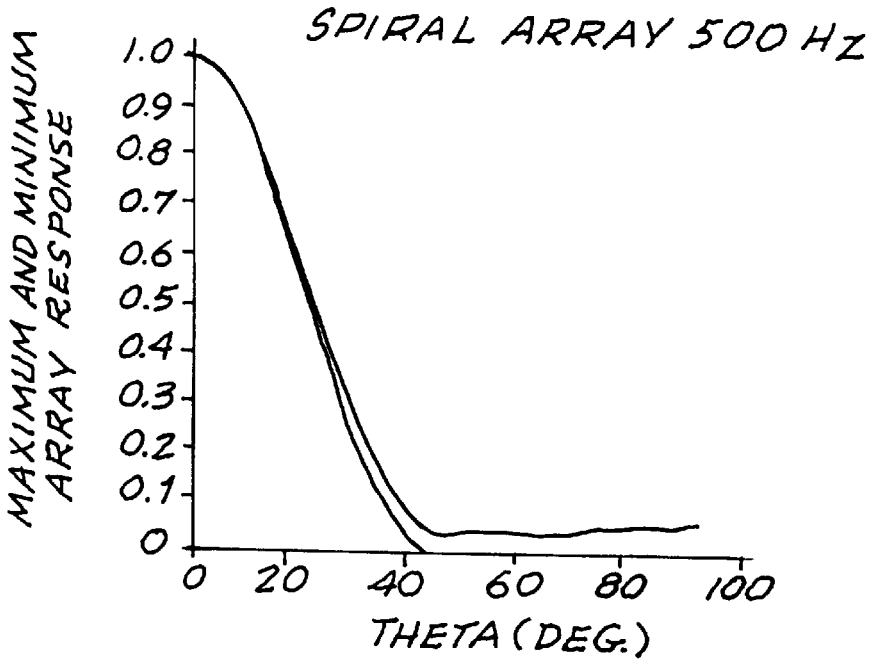
FIG. 5 summarizes the performance of spiral array at 500 Hz.

FIG. 4 and FIG. 5 summarize the performance of the square and spiral arrays at 500 Hz. Both arrays have about 34 degrees of resolution and acceptable sidelobes at this frequency.

Figure 6:
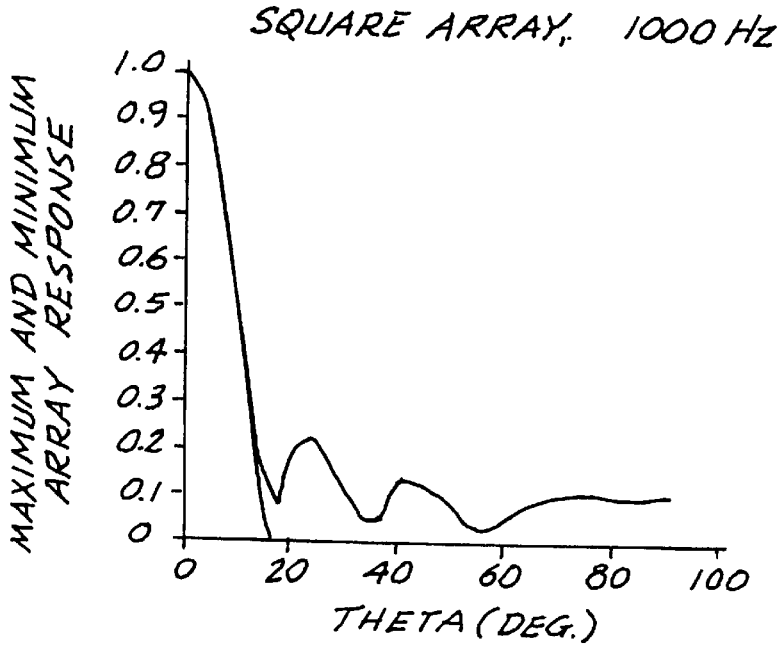
FIG. 6 summarizes the performance of square array at 1000 Hz.
Figure 7:
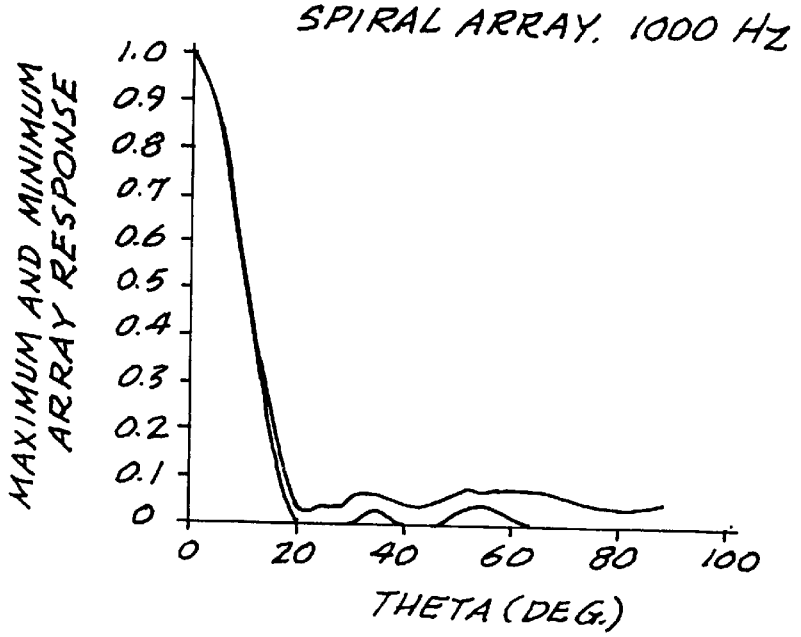
FIG. 7 summarizes the performance of spiral array at 1000 Hz.

FIG. 6 and FIG. 7 give array performance at 1000 Hz. Both arrays have 20 Deg. resolution and acceptable sidelobes.

Figure 8:
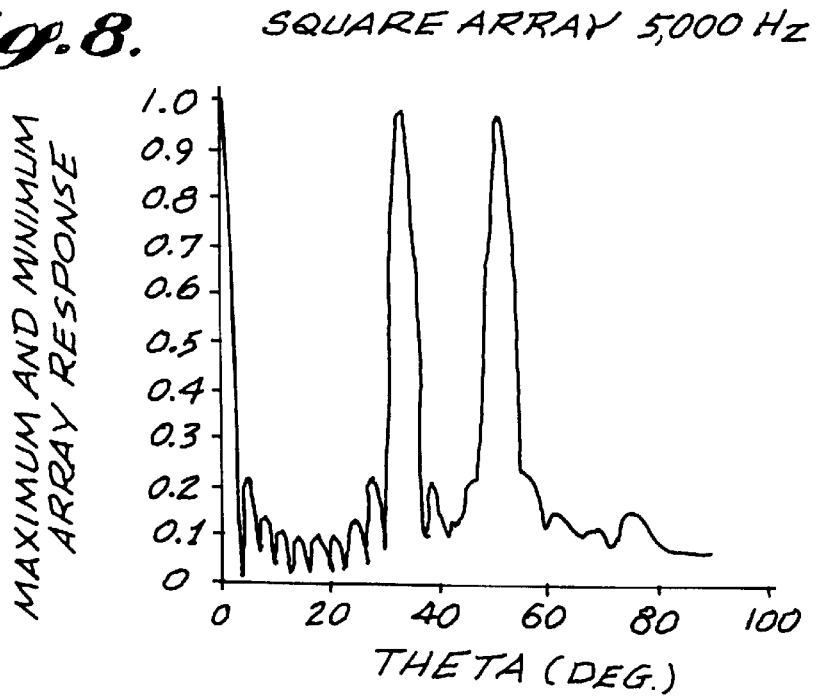
FIG. 8 summarizes the performance of square array at 5000 Hz.
Figure 9:
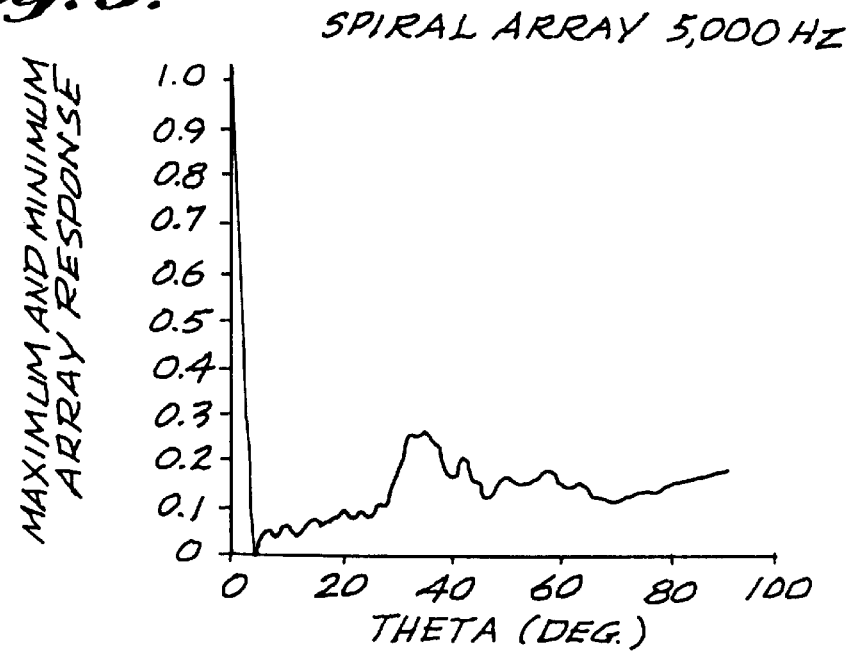
FIG. 9 summarizes the performance of spiral array at 5000 Hz.

FIG. 8 and FIG. 9 give the performance of the two arrays at 5000 Hz. It is seen that the resolution of both arrays is about 5 degrees. The square array has aliases at this frequency, as expected. The spiral array has acceptable sidelobes levels.

Figure 10:
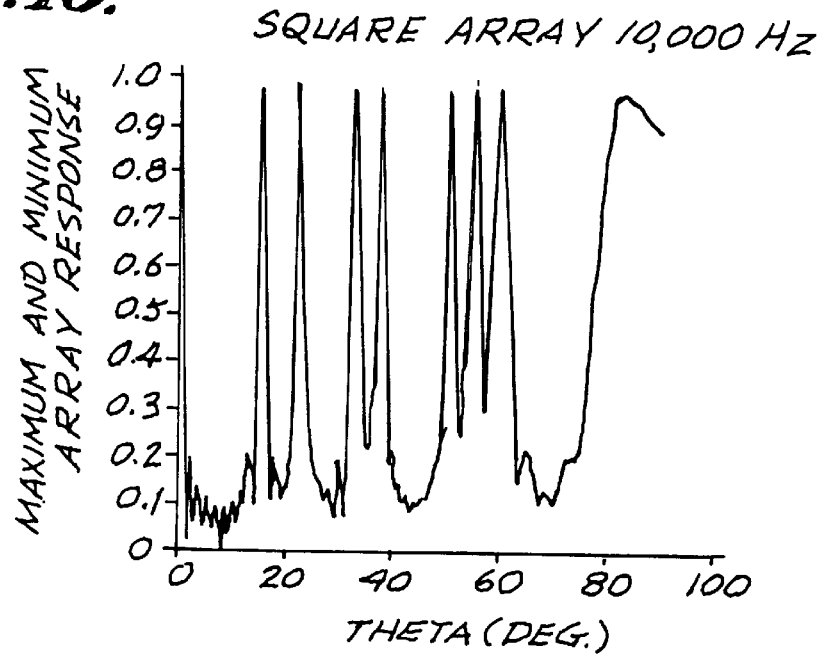
FIG. 10 summarizes the performance of square array at 10,000 Hz.
Figure 11:
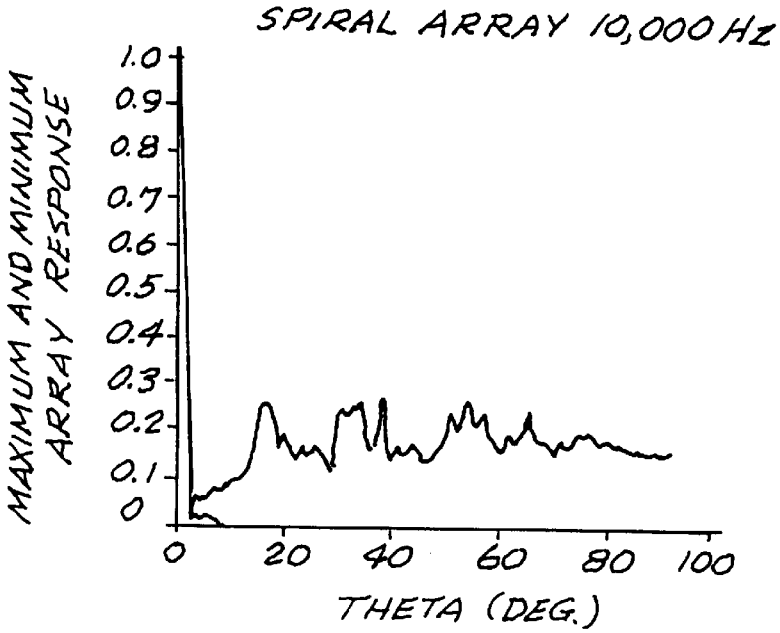
FIG. 11 summarizes the performance of spiral array at 10,000 Hz.

FIG. 10 and FIG. 11 represent the arrays at 10,000 Hz. The central lobes are very tight. The square array has so many aliases that it would probably be useless for almost any application. The spiral array has acceptable sidelobes.

Figure 12:
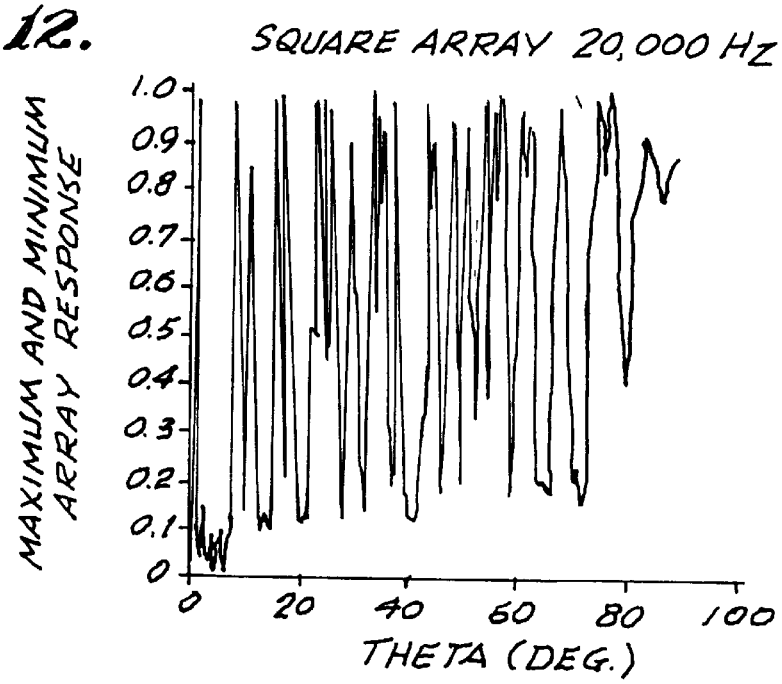
FIG. 12 summarizes the performance of square array at 20,000 Hz.
Figure 13:
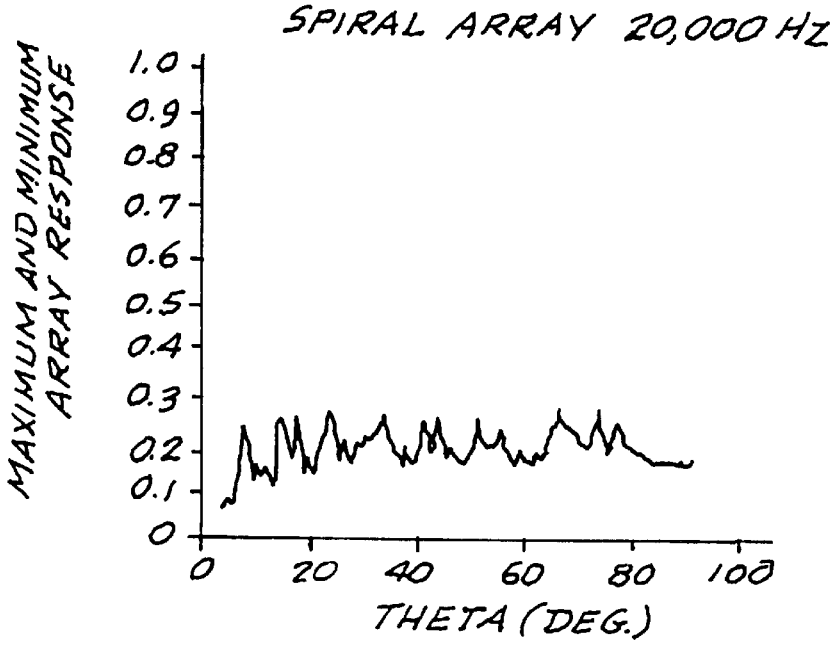
FIG. 13 summarizes the performance of spiral array at 20,000 Hz.

FIG. 12 and FIG. 13 give the patterns at 20,000 Hz. The square array has even more sidelobes. The spiral array has acceptable sidelobes. The central peaks have become almost invisible. Some measure to artificially broaden the peaks may be necessary in practice.

Figure 14:
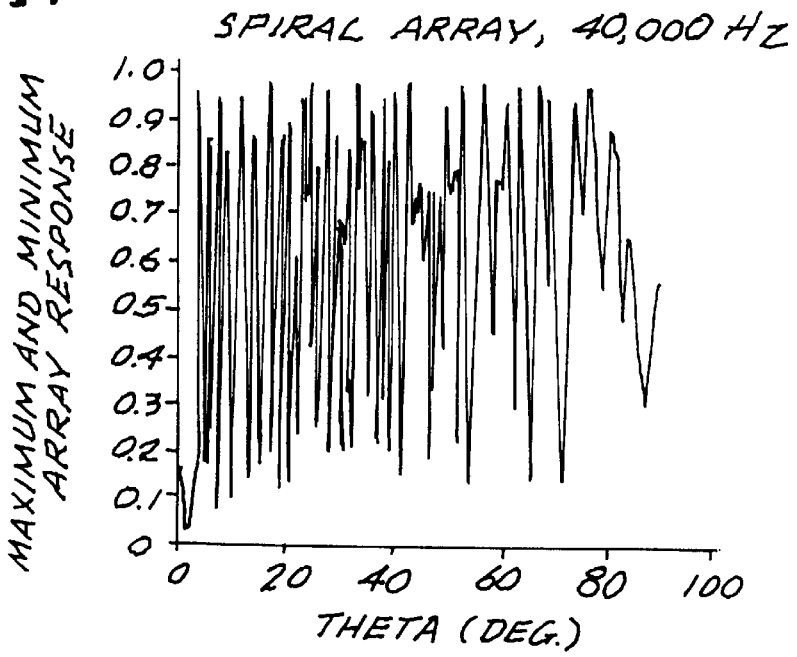
FIG. 14 summarizes the performance of square array at 40,000 Hz.
Figure 15:
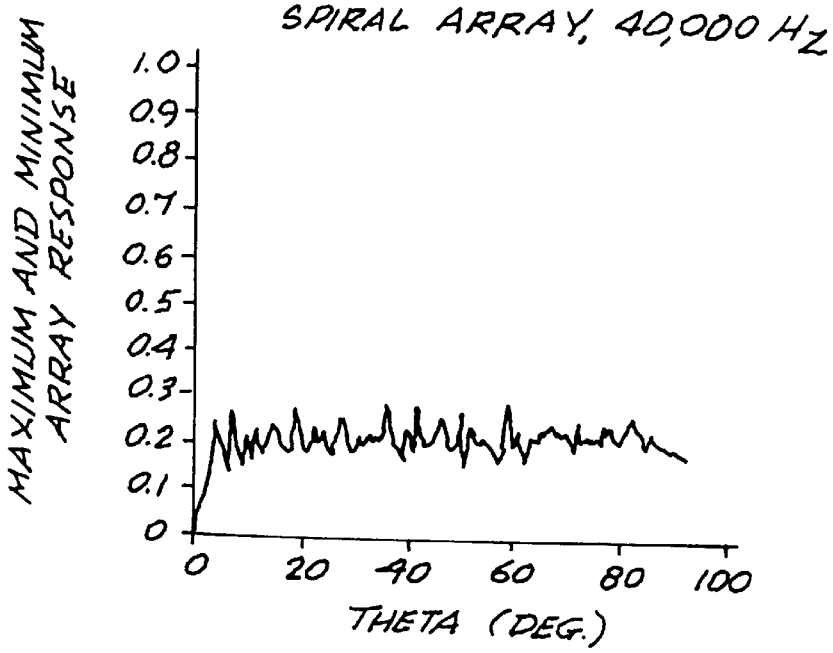
FIG. 15 summarizes the performance of spiral array at 40,000 Hz.

FIG. 14 and FIG. 15 show that the aliases of the square array seem to be filling the hemisphere at 40,000 Hz. The sidelobes of the spiral array are acceptable.

Figure 16:
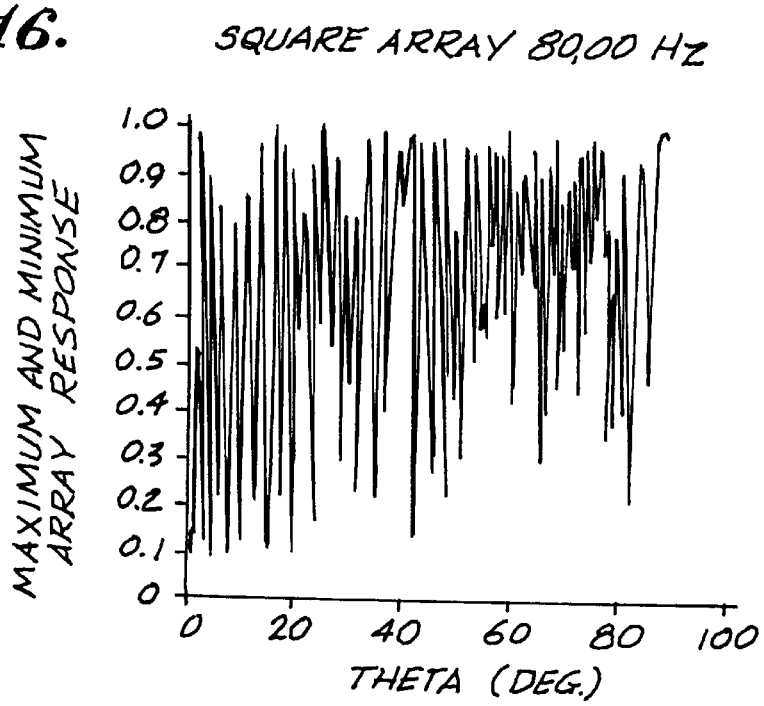
FIG. 16 summarizes the performance of square array at 80,000 Hz.
Figure 17:
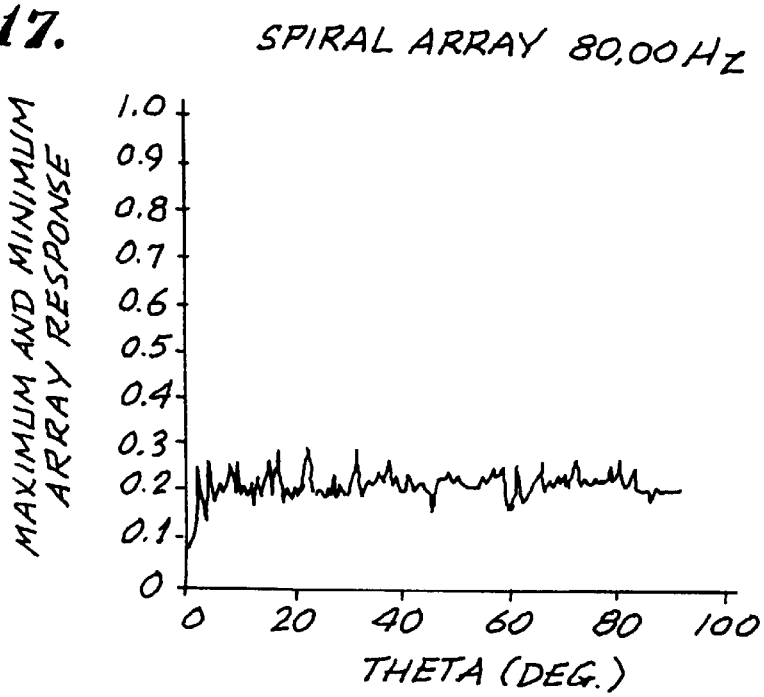
FIG. 17 summarizes the performance of spiral array at 80,000 Hz.

FIG. 16 and 17 give the array patterns at 80,000 Hz. The pattern for the square array seem qualitatively similar to the pattern st 40,000 Hz. The spiral array still has acceptable sidelobes.

What is claimed is:

1. A phased array having a plurality of elements disposed along a logarithmic spiral curve.

2. A phased array comprising a plurality of transducers positioned along a logarithmic spiral curve and coupled to a plurality of converters, said plurality of converters coupled to a computer for performing mathematical operations associated with beam forming.

* * * * *